US006216424B1

(12) United States Patent
Yoshida

(10) Patent No.: US 6,216,424 B1
(45) Date of Patent: Apr. 17, 2001

(54) METHODS FOR PRODUCING A SELF-SUPPORTING BAG AND PACKAGE

(75) Inventor: You Yoshida, Tokyo (JP)

(73) Assignee: Sumitomo Bakelite Company Limited, Tokyo (JP)

( * ) Notice: Subject to any disclaimer, the term of this patent is extended or adjusted under 35 U.S.C. 154(b) by 0 days.

(21) Appl. No.: 09/568,585

(22) Filed: May 11, 2000

Related U.S. Application Data

(62) Division of application No. 09/135,673, filed on Aug. 18, 1998, now abandoned.

(30) Foreign Application Priority Data

Sep. 1, 1997 (JP) ..... 9-235713

(51) Int. Cl.[7] ..... B65B 61/18

(52) U.S. Cl. ..... 53/412; 53/455; 53/133.1

(58) Field of Search ..... 53/455, 467, 412, 53/568, 129.1, 133.1

(56) References Cited

U.S. PATENT DOCUMENTS

| | | | | |
|---|---|---|---|---|
| 2,265,075 | * | 12/1941 | Knuetter | 53/412 |
| 3,337,117 | | 8/1967 | Lehmacher et al. | 383/104 |
| 3,380,646 | | 4/1968 | Doyen et al. | 383/104 |
| 3,799,914 | | 3/1974 | Schmit et al. | 383/113 |
| 4,224,367 | | 9/1980 | Scholle | 383/113 |
| 4,614,074 | * | 9/1986 | Evers | 53/128 |
| 4,795,271 | * | 1/1989 | Lane, Jr. et al. | 53/412 |
| 5,352,043 | | 10/1994 | Takagaki et al. | 383/104 |
| 5,425,583 | | 6/1995 | Wild | 383/202 |
| 5,830,545 | | 11/1998 | Frisk | 383/113 |
| 5,873,656 | | 2/1999 | Arkins et al. | 383/202 |
| 5,937,617 | * | 8/1999 | Yeager | 53/412 |
| 6,079,184 | * | 6/2000 | Cassou et al. | 53/412 |

FOREIGN PATENT DOCUMENTS

| | | |
|---|---|---|
| 662 613 | 8/1965 | (BE) . |
| 14 36 818 | 1/1969 | (DE) . |
| 3803678 | 8/1989 | (DE) . |
| 0 052 151 | 5/1982 | (EP) . |
| 0541 821 | 5/1993 | (EP) . |
| 61-137539 | 8/1986 | (JP) . |
| 62-90353 | 6/1987 | (JP) . |
| 63-34070 | 3/1988 | (JP) . |
| 63-171350 | 11/1988 | (JP) . |
| WO 98/23498 | 6/1998 | (WO) . |

* cited by examiner

*Primary Examiner*—Peter Vo
*Assistant Examiner*—John Paradiso
(74) *Attorney, Agent, or Firm*—Smith, Gambrell & Russell

(57) ABSTRACT

The present invention provides, at low cost, a self-supporting package which is excellent in heat resistance and can be sterilized at high temperatures and the content of which is drunk through a straw. That is, the present invention provides a self-supporting bag which comprises front and back materials consisting of a composite film having a seal layer and having flexibility, and a bottom material consisting of said composite film and folded in the form of the letter W between the front material and the back material, wherein a straw-thrusting film consisting of said composite film is folded in the form of the letter M between the front material and the back material in inverse direction to the bottom material and provided from one side seal to the other side seal of the self-supporting bag, the straw-thrusting film being heat-welded to either one of the front material and the back material, and further provides a self-supporting package comprising said self-supporting bag which is charged with a content and closed by sealing, wherein a seal part is provided in the upper portion of the bag, said seal part having an unsealed part having a width of 2 mm or more in longitudinal direction including therein the upper edge of the straw-thrusting film and a width in lateral direction within the width of the self-supporting bag.

8 Claims, 4 Drawing Sheets

METHODS FOR PRODUCING A SELF-SUPPORTING BAG AND PACKAGE

This application is a division of application Ser. No. 09/135,673, filed on Aug. 18, 1998 now abandoned.

BACKGROUND OF THE INVENTION

1. Field of the Invention

The present invention relates to a self-supporting package particularly for beverages and for drinking the content through a straw, and to a method for producing the same.

2. Description of the Related Art

At present, as beverage containers, mention may be made of cans, glass bottles, blown bottles, paper packs and the like, but they have both merits and demerits in productivity, handleability, saving of resources, refuse disposal, preservation, design and the like. Particularly, the paper packs to which straws are attached, are very popular and are supplied at a low price, while they have demerits that they lack variety in shapes and the content cannot be seen. Recently, soft packaging containers in the form of a bag made of laminated films which have injection-molded spouts and caps have been developed, and these have been provided mainly at the field of foods such as beverage containers of small capacity owing to their excellent functions such as preservation, heat resistance, saving of resources and reclosability. Such soft packaging containers with spouts are disclosed in JP-U-61-137539, JP-U-62-90353, JP-U-63-34070, and JP-U-63-171350.

However, structure of these soft packaging containers with spouts is complicated, because a bag formed of laminated film is combined with an injection-molded spout in order to assure the excellent functions, and naturally they are higher in cost than other containers of the same capacity. Furthermore, in the case of beverage containers of small capacity, mostly the content is drunk up at one time, and hence the functions given thereto are superfluous. Thus, cheaper containers have been desired from the point of price of the products as a whole. Moreover, the soft packaging containers with spouts are not suitable for contents which require sterilization at high temperatures, and containers which are not limited in their contents have been desired.

BRIEF SUMMARY OF THE INVENTION

The object of the present invention is to provide cheap self-supporting packages for drinking the content through a straw which are superior in heat resistance and can be subjected to sterilization at high temperatures.

The present invention relates to a self-supporting bag (1) which comprises a front material (2) and a back material (3) each consisting of a composite film having a seal layer and having flexibility, and a bottom material (4) consisting of said composite film and folded in the form of the letter V between the front material (2) and the back material (3), wherein a straw-thrusting film (6) consisting of said composite film is folded in the form of the letter V between the front material (2) and the back material (3) in inverse direction to the bottom material (4) and provided from one side seal to the other side seal of the self-supporting film (1), the straw-thrusting film (6) being heat-welded to either one of the front material (2) and the back material (3).

Furthermore, the present invention relates to a self-supporting package comprising said self-supporting bag (1) which is charged with a content and closed by sealing, wherein a seal part (7) is provided in the upper portion of the bag (1), said seal part (7) having an unsealed part (8) measuring 2 mm or more in longitudinal direction including therein the upper edge of the straw-thrusting film (6) and a width in lateral direction within the width of the self-supporting bag (1).

Moreover, the present invention relates to a method for producing a self-supporting bag which comprises feeding a front material (2) and a back material (3) each consisting of a composite film having a seal layer and having flexibility so that the seal layers face each other, feeding a straw-thrusting film (6) consisting of said composite film between the front material (2) and the back material (3) with folding in half so that the seal layer faces outside, heat-welding the straw-thrusting film (6) to either one of the front material (2) and the back material (3) at a narrower than the width of the straw-thrusting film (6) folded in half, feeding a bottom material (4) consisting of said composite film between the front material (2) and the back material (3) with folding in half so that the seal layer faces outside, and carrying out bottom sealing and side sealing.

In addition, the present invention relates to a method for producing a self-supporting package which comprises charging said self-supporting bag (1) with a content and closing the bag (1) by sealing at a seal part (7) provided in the upper portion of the bag (1), said seal part (7) having an unsealed part (8) measuring 2 mm or more in longitudinal direction including the upper edge of the straw-thrusting film (6) and a width in lateral direction within the width of the self-supporting bag (1).

Figure 1:
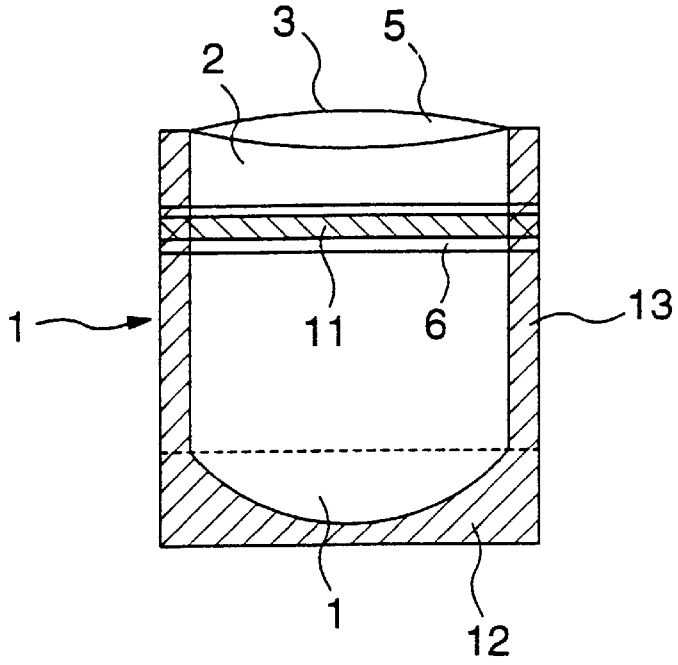
FIG. 1 is a front view showing an example of the self-supporting bag of the present invention.

The reference numerals in these figures have the following meanings.

1: Self-supporting bag; 2: Front material; 3: Back material; 4: Bottom material; 5: Opening; 6: Straw-thrusting film; 7: Seal part; 8: Unsealed part; 9: Cutting off line; 11: Seal part of straw-thrusting film; 12: Bottom seal part; 13: Side seal portion; 14: Sealing hot platen; 15 Sealing pad; 16: Sealing hot platen.

DETAILED DESCRIPTION OF THE INVENTION

The front material (2), the back material (3), the bottom material (4) and the straw-thrusting film (6) which constitute the self-supporting bag of the present invention each consist of a composite film having a seal layer and having flexibility. Preferably, the surface layer thereof consists of a polyamide film, a polyethylene terephthalate film or a laminated film of them, and the seal layer thereof consists of a polyolefin film, an ethylene-vinyl acetate copolymer film or a laminated film of them. When barrier property is needed, a film having barrier property such as an aluminum foil, an ethylene-vinyl alcohol copolymer film or a laminated film of them is provided as an intermediate layer, or aluminum, aluminum oxide, silicon oxide or the like is vapor-deposited on the surface layer, or polyvinylidene chloride or the like is coated on the surface layer, thereby to protect the content.

Material of the straw-thrusting film of the present invention basically consists of the same material as that of the self-supporting bag per se, but for easy thrusting of a straw, thickness of the film may be made thinner within the range causing no problem in the performance of the bag or the surface layer may be omitted as far as no problem is caused in the performance. Furthermore, it may be made easier to thrust a straw through the straw-thrusting film by making innumerable fine holes through the surface layer.

In the self-supporting bag of the present invention, the position of the straw-thrusting film to be inserted is such that the upper edge of the straw-thrusting film folded in half is positioned at a distance of 1–50 mm, preferably 15–30 mm below the upper edge of the self-supporting bag. The width of the straw-thrusting film often being folded is 5–40 mm, preferably 10–20 mm. The position of the lower edge of the closing seal after charging of the content is 1 mm or more above the lower edge of the straw-thrusting film and not more than the height of the straw-thrusting film and preferably in the range of 3–10 mm. The size of the unsealed part in the seal part is such that the lower edge thereof is in the range of 0–30 mm, preferably 0–3 mm, below the upper edge of the straw-thrusting film and the upper edge of the unsealed part is in the range of 2–40 mm, preferably 5–10 mm, above the upper edge of the straw-thrusting film.

According to the self-supporting package of the present invention, since it is in the form of self-supporting bag consisting of a composite film, it is superior in suitability for the content such as preservation and heat resistance and has self-supporting property and variety of the shapes, and besides, in some case, the content can be seen. Furthermore, since the content can be drunk through a straw, the container per se is not complicated and the container can be supplied cheaply.

Moreover, since sterilization at high temperatures is possible, the contents are not limited to only those which are sterilized at about 85° C. and charged in the soft packaging containers with spouts and can be more freely selected, and development of beverages in the new field can be expected.

EXAMPLE

The present invention will be illustrated below referring to the accompanying drawings.

Figure 2:
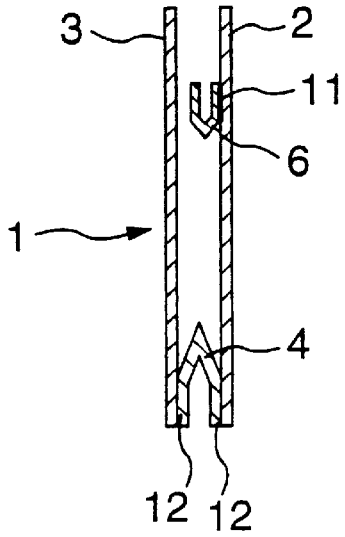
FIG. 2 is a side sectional view showing an example of the self-supporting bag of the present invention.
Figure 3:
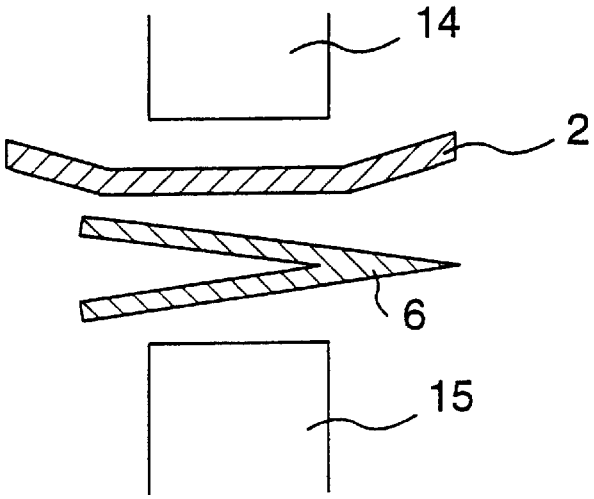
FIG. 3 is a side sectional view showing an example of sealing method of the straw-thrusting film of the self-supporting bag according to the present invention.

FIG. 1 and FIG. 2 show one example of the self-supporting bag of the present invention. The front material 2, the back material 3 and the bottom material 4 formed in the form of the letter V between the front and back materials in the self-supporting bag 1 each consist of a polyethylene terephthalate film of 12 μm, an aluminum foil of 7 μm, a nylon film of 15 μm and a polyethylene film of 60 μm in succession from the surface layer toward the seal layer. First, the straw-thrusting film 6 consisting of a polyethylene terephthalate film of 12 μm, an aluminum foil of 7 μm, and a polyethylene film of 40 μm in succession from the surface layer toward the seal layer is folded with the seal layer facing outside between the front material 2 and the back material 3 in such a manner that the film 6 folded in half in the form of the letter V just in inverse direction to the bottom material 4 has a height of 15 mm and the upper edge thereof is positioned at 20 mm below the opening 5 of the upper edge of the self-supporting bag. Then, as shown in FIG. 3, the front material 2 and the straw-thrusting film 6 are sealed to give the seal 11 which is in the range of from 2 mm below the upper edge of the straw-thrusting film 6 to 5 mm above the lower edge of the straw-thrusting film 6. Thereafter, between the front material 2 and the back material 3, the bottom material 4 is folded with the seal layer facing outside in the form of the letter V, and the bottom sealing 12 and side sealing 13 are performed to produce the self-supporting bag 1.

Figure 4:
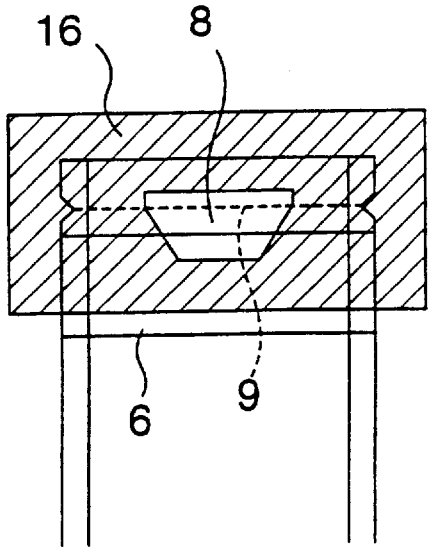
FIG. 4 is a front view showing an example of sealing method of the self-supporting package according to the present invention.
Figure 5:
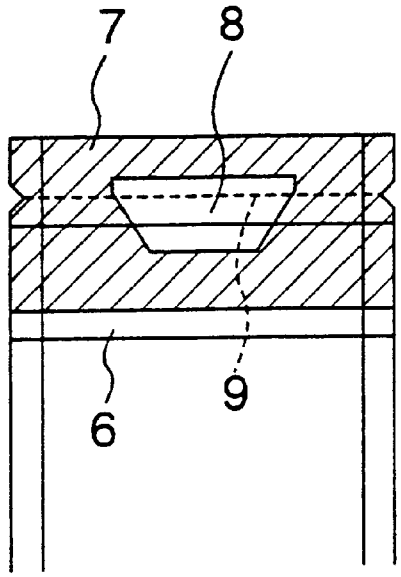
FIG. 5 is a front view showing an example of the self-supporting package of the present invention.
Figure 6:
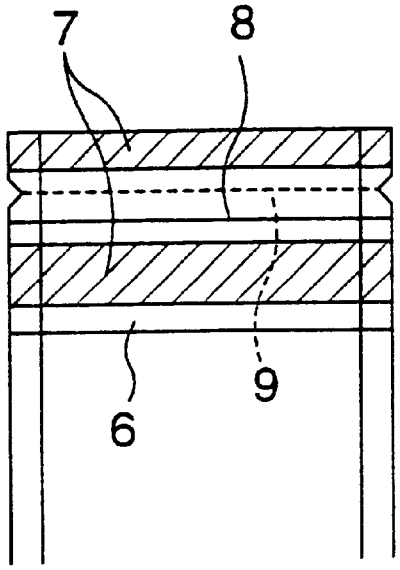
FIG. 6 is a front view showing another example of the self-supporting package of the present invention.
Figure 7:
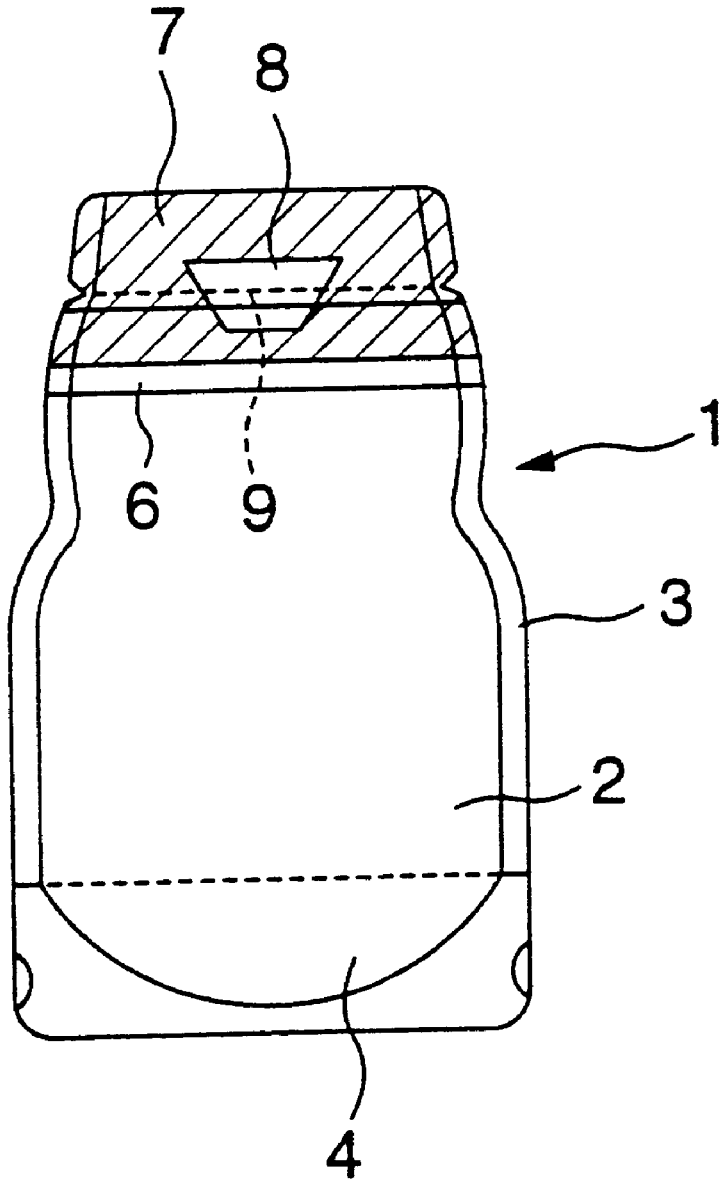
FIG. 7 is a front view showing further another example of the self-supporting package of the present invention.

In the self-supporting bag 1 mentioned above, the content is charged from the opening 5 formed between the straw-thrusting film 6 and the back material 3 which is not sealed to the film 6, and sealing is performed using a sealing plate 16 as shown in FIG. 4 to form a self-supporting package. As shown in FIG. 5, FIG. 6 or FIG. 7, the seal part 7 has a seal height ranging from the upper edge of the self-supporting bag 1 to 5 mm above the lower edge of the straw-thrusting film 6. An unsealed part 8 is provided in the seal part 7, and the lower edge of the unsealed part 8 is positioned at 2 mm below the upper edge of the straw-thrusting film 6 and the upper edge of the unsealed part 8 is positioned at 10 mm above the upper edge of the straw-thrusting film 6.

Furthermore, in the self-supporting package, when the bag 1 is sealed for closing, a cutting off line 9 which passes through the unsealed part 8 is provided at the position of 5 mm above the upper edge of the straw-thrusting film 6 in correspondence to the seal part 7.

In order to make easier to thrust a straw through the straw-thrusting film 6, thickness of the film 6 can be made thinner so far as no problem is caused in the properties of the container, or fine holes can be formed through only the surface layer constituting the straw-thrusting film 6. Moreover, the film 6 can be composed only of the barrier layer and the seal layer by omitting the surface layer.

The content contained in the self-supporting package of the present invention as shown in FIG. 7 can be drunk by cutting off the upper seal part at the cutting off line 9, inserting a straw from the unsealed part 8 and thrusting the straw through the straw-thrusting film 6.

What is claimed is:

1. A method for producing a self-supporting bag, comprising:

placing a front material and a back material, each comprising a flexible film composite having a seal layer, so that the seal layers face each other;

placing a straw-thrusting film, comprising a flexible film composite having a seal layer, between the front material and the back material at a top end thereof, folded in half in the form of a letter V, so that the seal layer of the straw-thrusting film faces outward;

heat-welding the straw-thrusting film composite to either the front material or the back material in a length which is less than the height of the straw-thrusting film folded in half, placing a bottom material comprising a film composite having a seal layer between the front material and the back material, folded in half in the form of an inverted letter V, so that the seal layer faces outside, sealing the bottom material to the front material and the back material, and sealing the front material to the back material at a first and a second longitudinal sides thereof, to form the self-supporting bag.

2. A method for producing a self-supporting package, comprising:

charging the self-supporting bag produced by the method of claim 1 with an intended content; and closing the bag at a seal part provided in the upper portion of the bag, said seal part having an unsealed part having a width of 2 mm or more in a longitudinal direction including therein the upper edge of the straw-thrusting film and a width in a lateral direction within the width of the self-supporting bag.

3. The method according to claim 2, wherein each of the film composites comprises a surface layer comprising at least one of a polyamide film, and a polyethylene terephthalate film, and a seal layer comprising at least one of a polyolefin film, and an ethylene-vinyl acetate copolymer film.

4. The method according to claim 3, wherein each of the film composites has an intermediate layer comprising at least one of an aluminum foil, and an ethylene-vinyl alcohol copolymer film, placed between the surface layer and the seal layer.

5. The method according to claim 3, wherein at least one of aluminum, aluminum oxide, and silicon oxide is vapor-deposited on the surface layer, or wherein polyvinylidene chloride is coated on the surface layer.

6. The method according to claim 1, wherein each of the film composites comprises a surface layer comprising at least one of a polyamide film, and a polyethylene terephthalate film, and a seal layer comprising at least one of a polyolefin film, and an ethylene-vinyl acetate film.

7. The method according to claim 6, wherein each of the film composites has an intermediate layer comprising at least one of an aluminum foil, and an ethylene-vinyl alcohol copolymer film, placed between the surface layer and the seal layer.

8. The method according to claim 6, wherein at least one of aluminum, aluminum oxide, and silicon oxide is vapor-deposited on the surface layer, or wherein polyvinylidene chloride is coated on the surface layer.

* * * * *